United States Patent [19]

McDowell

[11] Patent Number: 4,676,551

[45] Date of Patent: Jun. 30, 1987

[54] FANCY STOOL

[76] Inventor: John R. McDowell, 275 Marlborough, Bloomfield Hills, Mich. 48013

[21] Appl. No.: 782,037

[22] Filed: Nov. 12, 1985

[51] Int. Cl.[4] ..... A47C 9/12

[52] U.S. Cl. ..... 297/439; 297/461; 248/188.9

[58] Field of Search ..... 297/439, 219, DIG. 1, 297/461, 463, 445; D6/351; 248/188.8, 188.9

[56] References Cited

U.S. PATENT DOCUMENTS

| | | | |
|---|---|---|---|
| D. 272,489 | 2/1984 | Satterfield | D6/351 |
| D. 277,245 | 1/1985 | Unverzagt | D6/351 |
| 807,310 | 12/1905 | Palmenberg | 248/188.8 |
| 2,122,172 | 6/1938 | Bergmann | 297/463 |
| 2,251,318 | 8/1941 | Blair et al. | 297/DIG. 1 |
| 3,003,816 | 10/1961 | Wilson | 297/219 |
| 3,111,689 | 11/1963 | Mulhauser, Jr. | 297/DIG. 1 |
| 3,208,795 | 9/1965 | Schultz | 297/445 |
| 3,338,190 | 8/1967 | Hammond | 297/439 X |
| 3,674,230 | 7/1982 | Propst | 248/188.8 |
| 3,697,147 | 10/1992 | Schultz | 248/188.8 |

*Primary Examiner*—Francis K. Zugel

*Attorney, Agent, or Firm*—Gifford, Groh, VanOphem, Sheridan, Sprinkle and Dolgorukov

[57] ABSTRACT

A fancy stool having a seat supported by a pair of legs having the appearance of human legs and provided with shoes. The legs are made of lengths of wood timber with a wooden foot in the form of a platform attached to their bottom end and a spacer attached below the foot-like platform at the tip. The wood timber legs are covered with super-imposed layers of elastic fabric to provide a human leg appearance and texture. The legs are dressed with socks or stockings and shoes are passed over the feet with padding disposed between the feet and the shoe interior. Alternatively, the legs are made of plastic molding having the appearance of human legs and feet. The plastic legs preferably have a surface coating of elastomeric material to provide the consistency of human flesh.

3 Claims, 7 Drawing Figures

FIG. 3
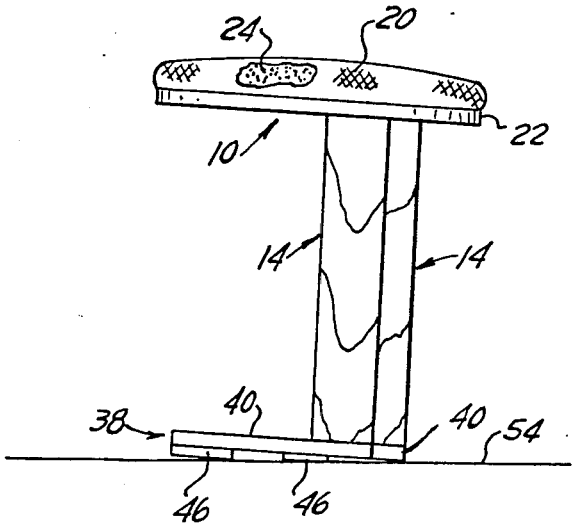
FIG. 4
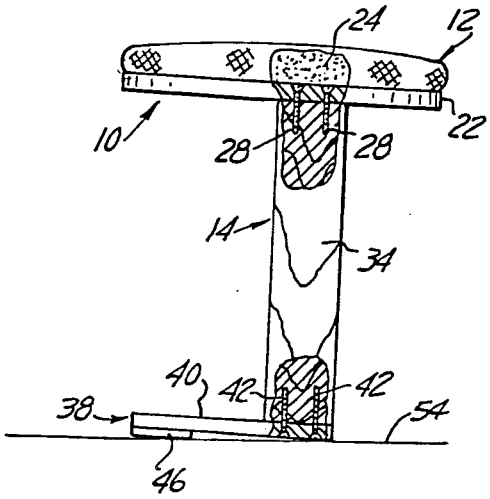
FIG. 5
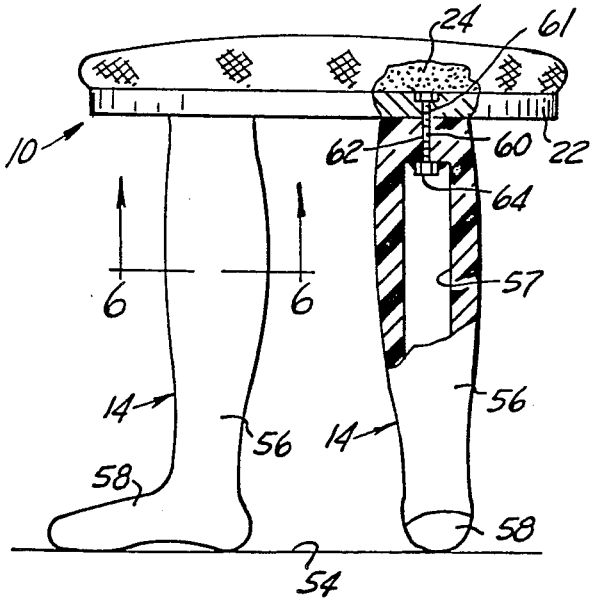
FIG. 6
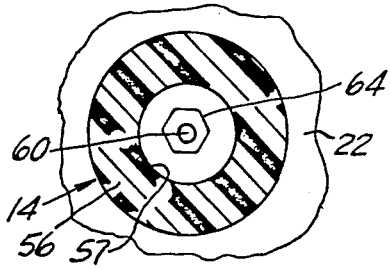
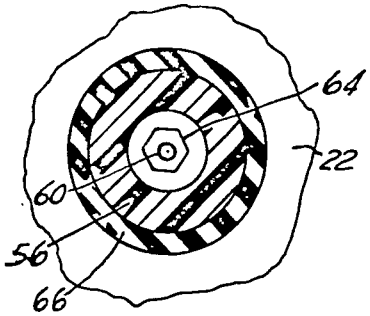
FIG. 7

FANCY STOOL

BACKGROUND OF THE INVENTION

The present invention relates to a stool in general, and more particularly to a fancy stool having legs modeled after human legs.

Sitting stools generally consist of a platform, made of hard material or covered with an appropriate upholstery over a resilient padding, and at least three legs supporting the platform from the ground. Stools may be made of wood, plastic or metal and they are functionally used as a seat, although they may, in addition, have such ornamental appearance as to stylishly form part of a furniture set or provide an ornamental visual impression.

SUMMARY OF THE INVENTION

The present invention provides a two-legged stool having legs dressed in the appearance of a pair of stockinged human legs and shod feet.

The principal object of the invention is to provide a two-legged and two-footed stool whose legs are dressed as a representation of stockinged human legs and whose feet are provided with shoes, with the result that the stool of the invention may be used as a conventional substantially stable stool for a person to sit on, for store display of shoes, socks and stockings, and for any other purpose that the user sees fit, such as being used as small low tables, for example.

The many objects and advantages of the present invention will become apparent to those skilled in the art when the following description of an example of structure according to the best mode contemplated, at the present, for practicing the invention, is read in conjunction with the accompanying drawing wherein:

BRIEF DESCRIPTION OF THE DRAWING

FIGS. 3 and 4 are respectively a plan elevation thereof and a side elevation thereof with portions removed to show the internal structure, and with clothing removed;

FIG. 5 is a view similar to FIG. 3, but showing a modification thereof;

FIG. 6 is a section along line 6—6 of FIG. 5; and

FIG. 7 is a view similar to FIG. 6, but showing a modification thereof;

DETAILED DESCRIPTION OF THE PREFERRED EMBODIMENTS

Figure 1:
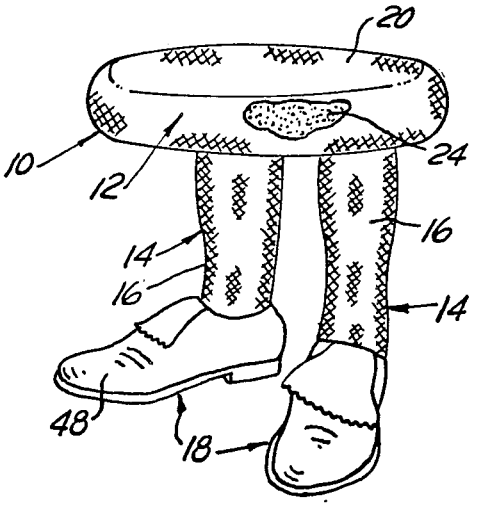
FIG. 1 is a perspective view of a fancy stool according to the present invention.
Figure 2:
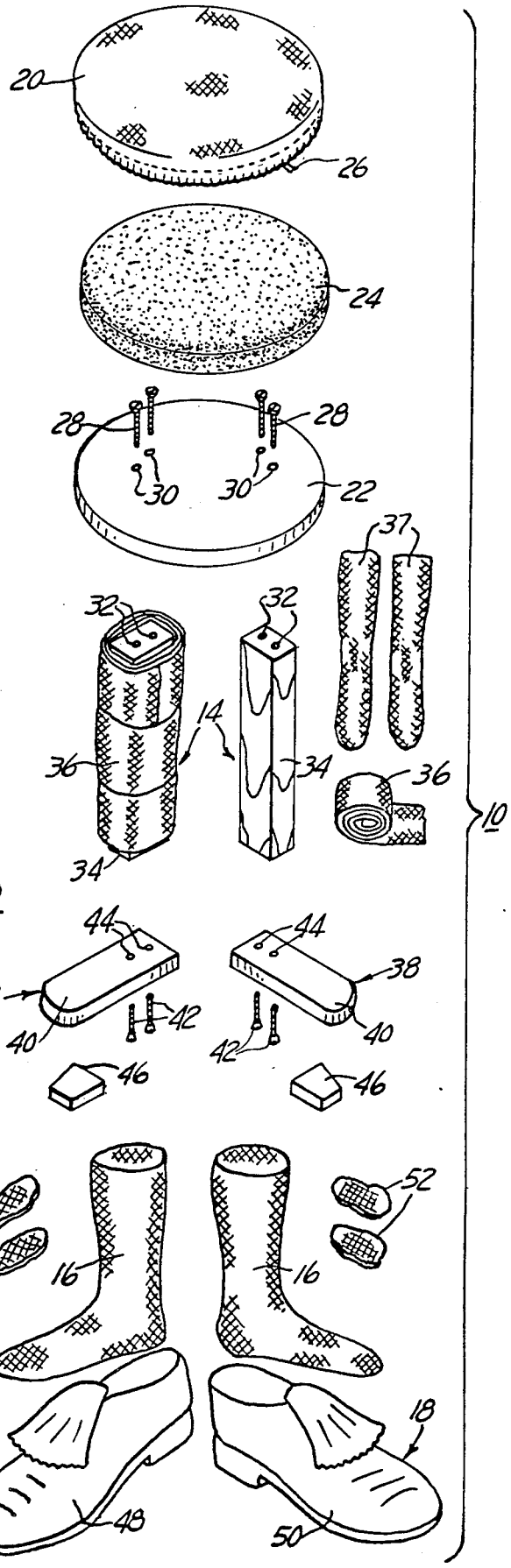
FIG. 2 is an exploded view thereof.

Referring to the drawing, and more particularly to FIGS. 1 and 2, a fancy stool 10 according to the present invention comprises a seat 12 and a pair of legs 14 in the appearance of human legs. The legs 14 are preferably clothed with stockings 16 and are provided with conventional shoes 18 at their bottom end. The legs 14 are attached at their top to the seat 12 which is, for example, circular and which is provided with a removable cover 20 made of any appropriate material, such as upholstery material, but preferably made simply of fabric of the kind used for manufacturing garments, for decorative purpose.

As best seen in the exploded view of FIG. 2 and at FIGS. 3 and 4, the stool seat 12 comprises a disc 22 of multiplywood, for example, on the top of which is fastened, by any convenient means such as by gluing a cushion 24 of elastomeric flexible and resilient material, the cover 20 having a hemmed edge through which is passed a tied pull string 26, preferably elastic, for attaching the cover 20 over the cushion 24. Prior to attaching the cushion 24 on the top of the plywood disc 22 the legs 14 are attached to the bottom of the disc 22 by means of appropriate mounting screws 28 passing through apertures 30 through the disc 22 and threading into predrilled bores 32 on the top of the legs 14. In the structure illustrated at FIGS. 2–4, the legs 14 are each made of a length of ordinary wood timber 34, such as $2\times4$ timber, which is covered with several wraps of an elastic fabric band 36. The elastic fabric band 36 is wrapped around each of the lengths of timber 34 in such manner as to give an overall visual impression of a human leg and, when covered by a sock or stocking 16, to provide a resilient flesh-like feel to the touch. The superimposed wraps of elastic fabric band 36 may be held in position and shape by knee-high stockings 37 fitted over the wrapped legs.

Feet 38 are attached to the bottom of the legs 14. Each foot 38 takes the form of an elongated block of plywood, or platform, 40 affixed to the bottom of one of the lengths of timber 34 by means of mounting screws 42 passed through predrilled mounting holes 44 and threading into the bottom face of the length of timber 34. Each block of plywood or platform 40 is provided at its tip with a small spacing block 46 of wood fastened, such as by cementing or by screws, to its bottom. After dressing the legs 14 with the stockings 16, the shoes 18, FIGS. 1 and 2, consisting of a right shoe 48 and left shoe 50 are installed by being passed over the foot block or platform 40 with the end of each foot block or platform 40 provided with the block 46 disposed at the tip of each shoe 48 and 50. Pieces of elastomeric material or padding as shown at 52 of FIG. 2 are pushed into the shoes 48 and 50 such as to provide some padding filling up the spaces that may exist between the stockinged foot platforms 40 and the interior of the shoes.

As shown at FIG. 3 and more particularly at FIG. 4, which both illustrate the framework of the stool 10 of the invention prior to stuffing and forming the legs to a human shape with the elastic fabric bands 36 and prior to dressing with stockings 16 and shoes 18, the top of the legs 16 made of lengths of timber 34 are attached to the bottom of the seat 12 at symetrical positions relative to the center of the seat 12 intermediate between the center of the seat and the edge thereof. The wooden blocks or platforms 40 forming the feet 38 of the seat 12 projecting beyond the center of gravity of the assembly provide a sturdy support for the stool 10 in spite of the stool 10 being provided only with two legs. Furthermore, the small spacing block 46 attached below each foot block or platform 40, even after insertion in a shoe 18, causes the stool 10 to rest on a horizontal surface 54 such as to lift the tip of the feet 38, thus causing the stool 10 to be supported with a slight rearward slant or at least with the seat 12 substantially horizontal. When a person sits on the seat 12 facing in the direction of the tips of the stool feet 38, any tendency of the stool 10 to tip forward is somewhat inhibited, as forward tip of the stool causes the seat 12 to rise. Furthermore, the spacing blocks 46 compensate to some extent for shoes 18 having a relatively high heel, and it will be appreciated that the stool 10 may be dressed with stockings and shoes with appropriate location of the paddings 52 placed in the shoes such as to cause the seat 12 to be substantially horizontal or, if so desired, to slant slightly rearwardly.

FIG. 5 illustrates a modification of the framework for a stool 10 according to the invention, wherein each leg 14 is made of a plastic molding 56, preferably hollow as shown at 57, having the appearance of a human leg provided with an integrally formed or attached foot 58. The plastic molded legs 14 are each attached to the bottom of the seat disc 22, which may also be made of plastic, by being bonded thereto or, alternatively, affixed by a screw 60 passed through an aperture 61 through the seat disc 22 and a bore 62 in the leg end, the screw 60 threading at its end into a captive nut 64, as illustrated. In addition, the end face of each plastic leg 14 may be coated with an appropriate adhesive prior to mounting below the seat disc 22.

Alternatively, the plastic legs 14 may consist of a, preferably hollow, hard plastic molding 56, FIG. 7, covered with a coating of elastomeric material forming a resilient sleeve 66 shaped as a human leg and providing a consistency to the touch similar to that of human calf flesh and skin, with hair if so desired.

It will be appreciated by those skilled in the art, that stools 10 of any appropriate height may be provided according to the present invention, such as, for example, relatively high bar stools, and that legs 14 consistent with the height at which it is desired to dispose the seat 12 may be used to support the seat, rather than the relatively short legs shown in the drawing for illustrative purpose only. It will also be appreciated that stools according to the invention may also be used as small tables, with or without the cushion 20 being omitted.

Having thus described the present invention by way of examples of structure well adapted to fulfill the objects of the invention, modifications whereof will be apparent to those skilled in the art, what is claimed as new is as follows:

1. A fancy stool comprising a seat, a pair of legs supporting said seat from a surface, each of said legs being provided at its bottom with an extended platform defining a foot, said legs each having an outward appearance similar to a human leg, a sock or stocking covering each of said legs and a pair of conventional shoes, each of said feet being disposed in one of said shoes wherein said legs are attached to said seat at an area intermediate the center of said seat and the edge thereof and each of said feet has an elevated tip extending beyond the center of gravity of said stool for causing said seat to be slanted rearwardly and to rise when tilted forwardly and wherein each of said feet is a wooden block having a spacing block attached below the toe end tip thereof whereby said seat is slanted rearwardly.

2. The fancy stool of claim 1 wherein said seat comprises a disc attached to the top of said legs, an elastomeric cushion attached to a top surface of said disc, a removable fabric cover disposed over said disc and said elastomeric cushion and means for holding said cover in position.

3. The fancy stool of claim 1 wherein each of said legs comprises a length of wood timber and a band of elastic fabric wrapped around said length of wood timber in such manner as to provide an appearance and consistency of a human leg.

* * * * *